United States Patent [19]

Thonnelier

[11] Patent Number: 4,874,413

[45] Date of Patent: Oct. 17, 1989

[54] PROCESS AND INSTALLATION FOR SUPPLYING NITROGEN TO AN APPARATUS

[75] Inventor: Jean-Yves Thonnelier, Sassenage, France

[73] Assignee: L'Air Liquide, Societe Anonyme Pour L'Etude et L'Exploitation des Procedes Georges Claude, Paris, France

[21] Appl. No.: 142,663

[22] Filed: Jan. 11, 1988

[30] Foreign Application Priority Data

Jan. 16, 1987 [FR] France ..... 87 00435

[51] Int. Cl.[4] ..... F25J 3/06

[52] U.S. Cl. ..... 62/23; 62/39

[58] Field of Search ..... 62/9, 11, 23, 32, 34, 62/38, 39

[56] References Cited

U.S. PATENT DOCUMENTS

| | | | |
|---|---|---|---|
| 3,461,680 | 8/1969 | Rische . | |
| 3,736,762 | 6/1973 | Toyana et al. | 62/39 X |
| 3,905,201 | 9/1975 | Coverey et al. | 62/38 X |
| 4,400,166 | 6/1963 | Patel et al. | 62/39 X |
| 4,526,595 | 7/1985 | McNeil | 62/34 X |
| 4,595,405 | 6/1986 | Agrowel et al. | 62/38 X |

FOREIGN PATENT DOCUMENTS 2200057 4/1974 France .

*Primary Examiner*—Steven E. Warner

*Attorney, Agent, or Firm*—Young & Thompson

[57] ABSTRACT

As the apparatus consumes liquid nitrogen and discharges cold gaseous nitrogen under low pressure, an additional nitrogen stream is liquified under high pressure by heat exchange with the gaseous nitrogen discharged by the apparatus 1, the liquid thus obtained is expanded to the pressure of utilization and the expanded liquid is added to the principal supply of liquid nitrogen to the apparatus. Application in the supply of nitrogen to large cryogenic crushing apparatus.

16 Claims, 2 Drawing Sheets

PROCESS AND INSTALLATION FOR SUPPLYING NITROGEN TO AN APPARATUS

The present invention relates to a process and installation for supplying nitrogen to an apparatus which consumes liquid nitrogen and discharges gaseous nitrogen at low temperature and low pressure.

A number of apparatus exist which employ the heat of vaporization of nitrogen for cooling a charge and which discharge very cold gaseous nitrogen whose freezing power cannot be made use of on the spot and is lost.

Thus, in a cryogenic crushing operation, the liquid nitrogen is employed for two purposes: on one hand for cooling the charge to be crushed in the screw or the supply hopper, from ambient temperature to the crushing temperature which is generally on the order of −140° to −150° C. and on the other hand for maintaining this temperature in the crusher by evacuation of the dissipated energy.

The quantity of cold required for the cooling of the charge depends on the product Cp Δ T, in which Cp is the specific heat of the product and Δ T the temperature difference, whereas the energy dissipated in the crusher depends on the aptitude of the product to be crushed, the desired particle size and the performances of the crusher.

In favourable cases, these two freezing needs are in equilibrium so that if liquid nitrogen is introduced into the crusher, the cold gaseous nitrogen generated in the region of the crusher can serve to pre-cool the charge, which results in an optimum recovery of the negative calories.

On the other hand, unfavourable cases exist, when the products have a high crushing energy, as for example certain elastomers, and when small particle sizes (below about 150 microns) are envisaged.

In such cases, the consumptions of liquid nitrogen are very high in the crusher and the quantity of cold nitrogen generated in the crusher is very greatly in excess relative to that necessary for the pre-cooling of the charge; these negative calories cannot be recovered by the process and are discharged to the atmosphere.

An object of the invention is to provide a process and installation for valorizing these negative calories discharged at low temperature.

The invention therefore provides a process comprising liquefying a stream of additional nitrogen at high pressure by heat exchange with the gaseous nitrogen discharged by the apparatus, expanding the liquid thus obtained to the supply pressure of the apparatus, and adding the expanded liquid to the principal supply of liquid nitrogen to the apparatus.

In one manner of carrying out the invention, the principal supply of liquid nitrogen is effected by an air-separating installation provided with a nitrogen liquefaction cycle, and the additional nitrogen is taken from the high pressure outlet of the cycle compressor.

In another manner of carrying out the invention, the principal supply of liquid nitrogen is effected by a storage of liquid nitrogen and the additional nitrogen is taken from a conduit distributing nitrogen under pressure.

The invention also provides an installation for carrying out the process described hereinbefore. This installation is of the type comprising a source of liquid nitrogen and a conduit for the principal supply of liquid nitrogen to the apparatus extending from said source to said apparatus and the installation further comprises a conduit for supplying additional gaseous nitrogen at high pressure, a heat exchanger for liquefying the additional gaseous nitrogen by heat exchange with the gaseous nitrogen discharged from the apparatus, means for expanding the thus liquefied nitrogen to the supply pressure of the apparatus, a phase separator receiving the expanded liquid nitrogen, and a conduit for supplying liquid collected in said phase separator to the apparatus.

A few embodiments of the invention will now be described with reference to the accompanying drawings in which.

Figure 1:
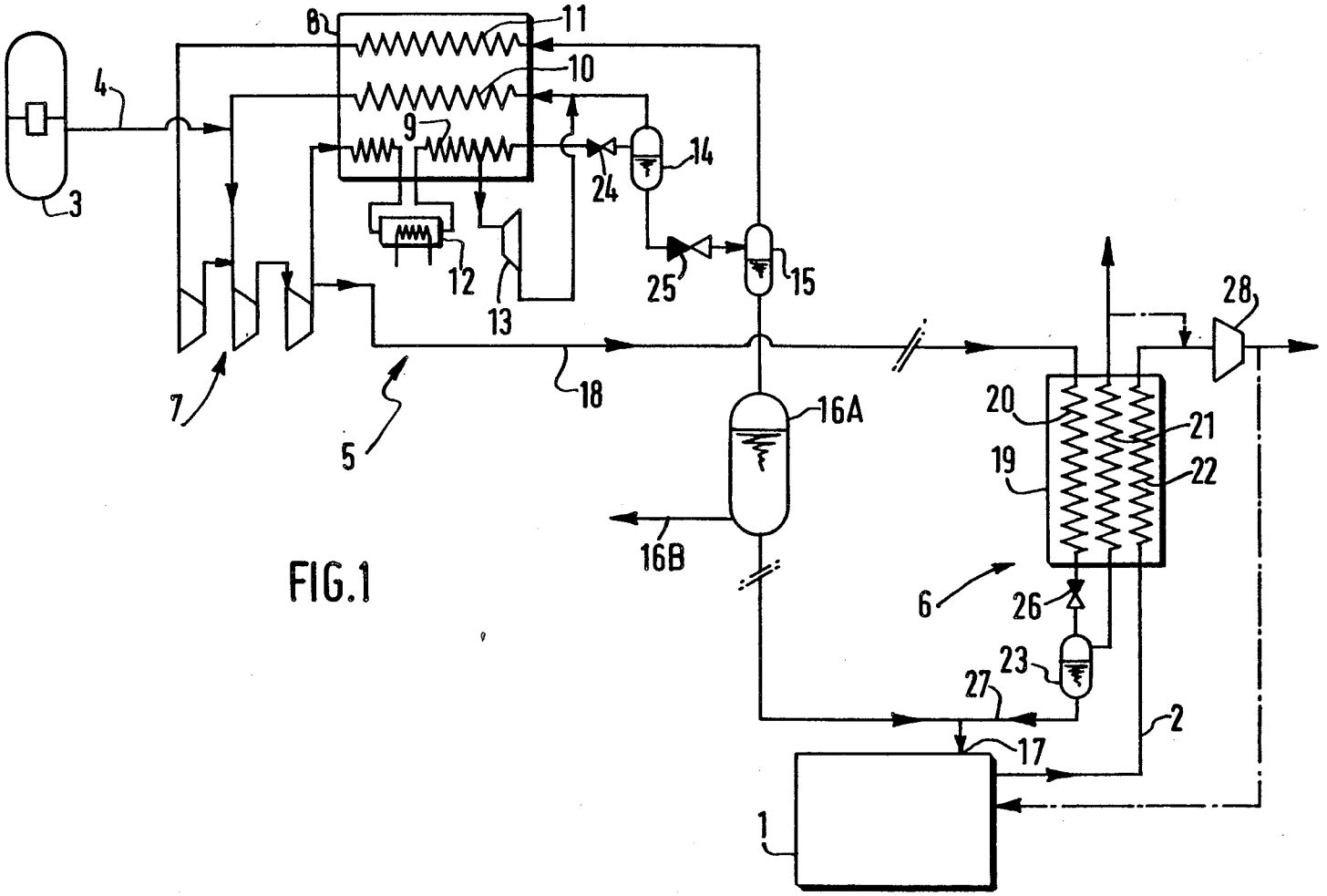
FIG. 1 is a diagram of an installation according to the invention.

The installation shown in FIG. 1 is adapted to supply nitrogen, and essentially liquid nitrogen, to an apparatus 1 (for example a cryogenic crushing apparatus) which, after having consumed liquid nitrogen, discharges gaseous nitrogen at low temperature, for example between −140° and −196° C., through a conduit 2. This installation essentially comprises an air separating installation 3, for example a double air distillation column, located in proximity to the apparatus 1, for example at a few tens or a few hundreds of meters from the latter, and producing gaseous nitrogen through a conduit 4, a nitrogen liquefaction cycle 5 associated with the installation 3, and an auxiliary liquefier 6 disposed in the immediate vicinity of the apparatus 1. In this embodiment, the liquid nitrogen supplied to the apparatus 1 and the discharge nitrogen are at roughly atmospheric pressure.

The liquefaction cycle 5 is conventional and comprises a three-stage cycle compressor 7 whose intake pressures are respectively about 1 bar, 6 bars and 20 bars (in absolute values) and whose outlet pressures are about 6 bars, 20 bars and 50 bars, a heat exchanger 8 having three series of passages 9 to 11 in mutual thermal exchange relation to one another, a refrigerating unit 12, an expansion turbine 13 and two phase separators 14 and 15 connected in series.

A principal liquid nitrogen supply conduit 16, insulated under a vacuum, leads from the bottom of the final separator 15 to the liquid nitrogen inlet 17 of the apparatus 1, through an intermediate storage vessel 16A. There may lead from this storage vessel another conduit 16B adapted to supply liquid nitrogen to other users, for example for the filling of tank trucks. An additional gaseous nitrogen supply conduit 18 leads from the high pressure outlet of the compressor 7.

The liquefier 7 comprises a heat exchanger 19 having three series of passages 20 to 22 and a phase separator 23.

The nitrogen produced by the installation 3 is conducted, in the neighbourhood of ambient temperature, through the conduit 4 to the inlet of the second stage of the compressor 7.

A part of the high pressure nitrogen issuing from the third stage of the compressor enters the passages 9 of the exchanger 8, emerges therefrom, is cooled by the refrigerating unit 12, again enters the passages 9 and a part thereof is cooled to the temperature of the cool end of the exchanger 8, expanded to about 6 bars in an expansion valve 24 and divided into two phases by the separator 14. The liquid collected in the latter is again expanded to a pressure a little higher than atmospheric pressure, in an expansion valve 25, divided into two phases in the final separator 15 and it is the liquid collected in the latter which enters the conduit 16 and constitutes the principal liquid nitrogen supply to the apparatus 1.

A part of the high pressure nitrogen circulating in the passages 9 is withdrawn from the exchanger 8, expanded to 6 bars in the turbine 13 and combined with the flash gas issuing from the separator 14 to provide a first cooling stream flowing in counter-current manner to the high pressure nitrogen in the passages 10, before returning to the inlet of the second stage of the compressor 7. The low pressure flash gas issuing from the separator 15 is conducted into the passages 11 in counter-current manner to the high pressure nitrogen and then returned to the inlet of the first stage of the compressor 7.

The high pressure gaseous nitrogen taken off through the conduit 18 enters the passages 20 of the exchanger 19 and emerges therefrom in the liquefied state supercooled to roughly the temperature of the cold nitrogen discharged by the apparatus 1, is then expanded to a pressure slightly higher than atmospheric pressure in an expansion valve 26, and then divided into two phases in the separator 23. The liquid collected in the latter is conveyed through a conduit 27 to the inlet 17 of the apparatus 1 and constitutes an additional liquid nitrogen supply for this apparatus. The flash gas of the separator 23 is conveyed in a counter-current manner in the passages 21 of the exchanger 19, and the conduit 2 is connected to the cold inlet of the passages 22. After reheating, the flash gas is discharged and the rejected nitrogen is also discharged generally by means of an extractor-fan 28. As a modification, these two gases may be combined and conveyed to the apparatus 1, for example for inert rendering purposes, as indicated in dot-dash lines, or the rejected nitrogen alone, which constitutes the principal flow, may be conveyed to the apparatus 1.

Thus, the addition to a conventional installation having only the installation 3 and the cycle 5, of the conduit 18 at ambient temperature and the heat exchanger 19, which is of modest dimensions, permits, for a low investment cost, the recovery of the refrigerating power at low temperature by creation of an additional supply of liquid nitrogen.

Figure 2:
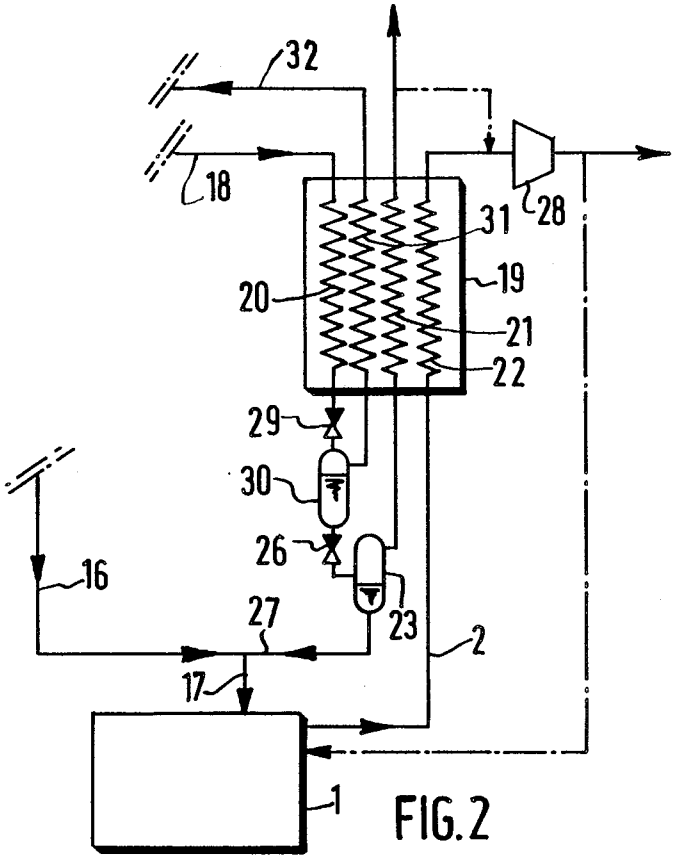
FIG. 2 is a diagram of a variant.

Furthermore, for reducing losses of nitrogen by flashing in the exchanger 19, the high pressure liquid nitrogen issuing from the passages 20 may be expanded, as shown in FIG. 2, in two stages by inserting a high pressure-medium pressure expansion valve 29 and an intermediate phase separator 30 between the outlet of the passages 20 and the valve 26. The flash gas of the separator 30 at roughly 6 bars is then reheated in supplementary passages 31 of the exchanger 19, then returned through a conduit 32 to the inlet of the second stage of the compressor 7 of FIG. 1.

Figure 3:
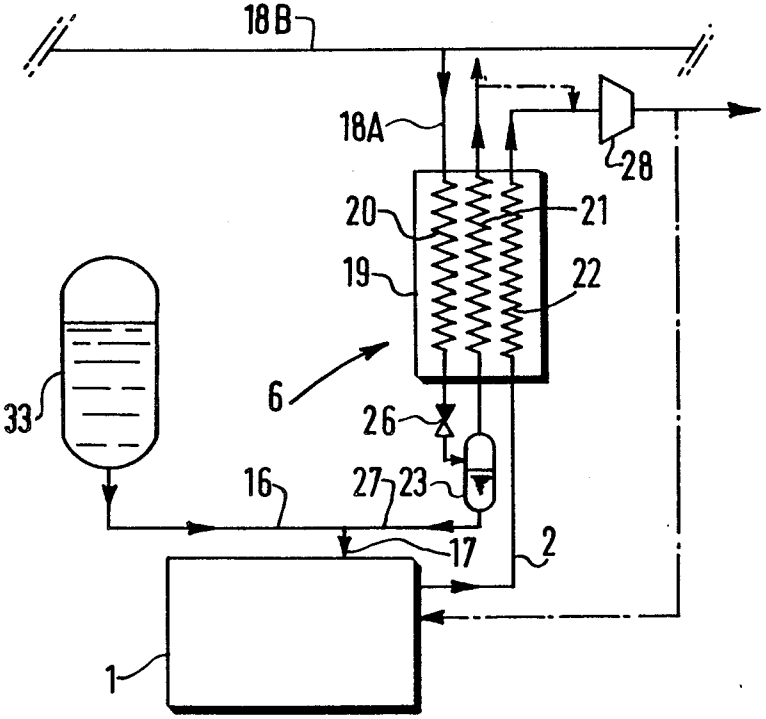
FIG. 3 is a diagram of another installation according to the invention.

The installation shown in FIG. 3 differs from that of FIG. 1 only in the origin of the principal stream of liquid nitrogen supplied to the conduit 16 and of the high pressure gaseous nitrogen stream entering the passages 20 of the exchanger. Indeed, when the air-separating installation is too remote from the apparatus 1, it is preferable to supply liquid nitrogen to the conduit 16 from a storage of liquid nitrogen 33 disposed in the immediate vicinity of the apparatus 1 and itself supplied by tank trucks, while the additional gaseous nitrogen is supplied either in the manner shown in FIG. 1 or by the connection of a conduit 18A to a conduit 18B distributing gaseous nitrogen at high pressure extending in proximity to the apparatus 1.

In order to increase the yield in the recovery of negative calories, it may be envisaged to provide the conduit 18 or 18A with a booster which brings the high pressure nitrogen to a pressure higher than that of the cycle 5 or of the conduit 18B, for example on the order of 80 bars, and/or to operate the apparatus 1, for example the cryogenic crusher, at a temperature which is lower than that strictly necessary for the process it carries out.

I claim:

1. Process for supplying nitrogen to an apparatus which has a principal supply of liquid nitrogen and discharges gaseous nitrogen at low temperature and low pressure, said process comprising liquefying an additional nitrogen stream under high pressure by heat exchange with said gaseous nitrogen discharged by said apparatus, expanding the liquid thus obtained to a supply pressure of said apparatus, and adding the expanded liquid to said principal supply of liquid nitrogen of said apparatus.

2. Process according to claim 1, further comprising effecting a heat exchange between the additional gaseous nitrogen and flash gas resulting from the expansion of the liquefied additional nitrogen.

3. Process according to claim 1, comprising effecting the principal liquid nitrogen supply by means of a liquid nitrogen storage replenished in a discontinuous manner.

4. Process according to claim 3, comprising supplying additional nitrogen to the apparatus by taking it from a conduit distributing nitrogen under pressure.

5. Process according to claim 1, wherein the gaseous nitrogen discharged by the apparatus and optionally the gas resulting from the final expansion of the liquefied nitrogen are returned to the apparatus.

6. Process according to claim 1, comprising effecting the principal liquid nitrogen supply by means of an air separating installation provided with a nitrogen liquefaction cycle, employing a compressor having a high pressure discharge, and taking the additional nitrogen from the high pressure discharge of said cycle compressor.

7. Process according to claim 6, further comprising effecting a heat exchange between the additional gaseous nitrogen and flash gas resulting from the expansion of the liquefied additional nitrogen, expanding the liquefied additional nitrogen in at least two stages, flash gas resulting from each intermediate stage being returned, after heat exchange with the gaseous additional nitrogen, to an intermediate stage of said cycle compressor.

8. Process according to claim 6, comprising causing said apparatus to operate at a temperature lower than the temperature strictly necessary for its operation.

9. Process according to claim 6, comprising boosting the additional nitrogen before said heat exchange.

10. Process according to claim 9, comprising causing said apparatus to operate at a temperature lower than the temperature strictly necessary for its operation.

11. An installation for supplying nitrogen to an apparatus having a liquid nitrogen inlet and an outlet discharging gaseous nitrogen at low temperature and low pressure, said installation comprising a liquid nitrogen source and a first conduit for a principal supply of liquid nitrogen to the apparatus connecting said source to the inlet of the apparatus, a second conduit for an additional supply of gaseous nitrogen under high pressure, a heat exchanger having an inlet connected to said second conduit and an outlet, a third conduit connecting said outlet of the apparatus to said heat exchanger for liquefying the additional gaseous nitrogen by thermal exchange with the gaseous nitrogen discharged from said apparatus, a fourth conduit connected to said outlet of said heat exchanger, means inserted in said fourth conduit for expanding the thus liquefied nitrogen to a supply pressure of the apparatus, a phase separator inserted in said fourth conduit for receiving the thus expanded liquid nitrogen, and a fifth conduit connecting said phase separator to said inlet of said apparatus for supplying liquid collected in said phase separator to said apparatus.

12. An installation according to claim 11, wherein said phase separator has a gas outlet connected to said heat exchanger for also putting the gas issuing from gas outlet of the phase separator in thermal exchange relation to the additional gaseous nitrogen under high pressure.

13. An installation according to claim 11, wherein the source of liquid nitrogen is constituted by an air separating installation provided with a nitrogen liquefaction cycle including a compressor having a high pressure outlet, and said second conduit is connected to the high pressure outlet of said compressor.

14. An installation according to claim 13, wherein said phase separator has a gas outlet connected to said heat exchanger for also putting the gas issuing from gas outlet of the phase separator in thermal exchange relation to the additional gaseous nitrogen under high pressure, said expansion means being in two stages, and a conduit is provided for returning a flash gas resulting from the or each intermediate stage, after heat exchange with the additional nitrogen in said exchanger, to an intermediate stage of said cycle compressor.

15. An installation according to claim 11, wherein the source of liquid nitrogen is a storage of liquid nitrogen replenished in a discontinuous manner.

16. An installation according to claim 15, wherein said second conduit for supplying additional gaseous nitrogen is branch connected to a conduit distributing nitrogen under pressure.

* * * * *